US006440535B1

(12) United States Patent
Iu et al.

(10) Patent No.: US 6,440,535 B1
(45) **Date of Patent: *Aug. 27, 2002**

(54) RECORDING SHEET FOR INK-JET PRINTING

(75) Inventors: Kai-Kong Iu, San Diego; Gary W. Byers, Vista, both of CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 37 days.

(21) Appl. No.: 09/028,509

(22) Filed: Feb. 23, 1998

(51) Int. Cl.[7] ..... B41M 5/00; B05D 5/04

(52) U.S. Cl. ..... 428/195; 428/329; 428/532; 427/384; 523/333; 523/351; 524/48; 524/437

(58) Field of Search ..... 428/195, 323, 428/328, 329, 532, 533; 162/175, 178; 427/384; 106/205.01; 523/223, 333, 351; 524/48, 437

(56) References Cited

U.S. PATENT DOCUMENTS

| | | | | |
|---|---|---|---|---|
| 2,923,704 A | | 2/1960 | Berger et al. | |
| 4,020,160 A | | 4/1977 | Bernstein et al. | 424/180 |
| 4,202,870 A | | 5/1980 | Weber et al. | 423/630 |
| 4,242,271 A | | 12/1980 | Weber et al. | 260/448 A |
| 4,247,535 A | | 1/1981 | Lewis et al. | 424/182 |
| 4,258,180 A | | 3/1981 | Lewis et al. | 536/112 |
| 4,383,992 A | | 5/1983 | Lipari | 424/238 |
| 4,676,928 A | | 6/1987 | Leach et al. | 252/313.1 |
| 4,917,956 A | * | 4/1990 | Rohrbach | 428/423.1 |
| 5,098,793 A | * | 3/1992 | Rohrbach et al. | 428/532 |
| 5,108,505 A | | 4/1992 | Moffatt | 106/25 |
| 5,141,599 A | | 8/1992 | Jahn et al. | 162/137 |
| 5,302,195 A | * | 4/1994 | Helbrecht et al. | 106/25 R |
| 5,725,961 A | * | 3/1998 | Ozawa et al. | 428/500 |
| 5,738,932 A | * | 4/1998 | Kondo et al. | 428/195 |
| 5,916,673 A | * | 6/1999 | Fryberg et al. | 428/328 |
| 5,928,127 A | * | 7/1999 | Tanuma | 516/93 |
| 5,948,512 A | * | 9/1999 | Kubota et al. | 428/195 |

FOREIGN PATENT DOCUMENTS

| | | |
|---|---|---|
| EP | 0696516 | 2/1996 |
| EP | 0716929 | 6/1996 |

OTHER PUBLICATIONS

Croft et al., "Synthesis of Chemically Modified Cyclodextrins", Tetrahedron Report Number 147, vol. 39, No. 9, 1983, pp. 1417–1474, No. month.

* cited by examiner

*Primary Examiner*—Marie Yamnitzky
(74) *Attorney, Agent, or Firm*—W. Bradley Haymond

(57) ABSTRACT

A recording sheet is disclosed comprising a substrate, having on at least one side thereon, an ink absorbent layer, said ink absorbent layer comprising alumina sol, at least one gelling agent, at least one cyclodextrin compound, and optionally, at least one binder. The ink absorbent layer may further comprise at least one viscosity, modifying compound and at least one gloss enhancing compound. The recording sheet of the present invention provides enhanced lightfastness properties.

26 Claims, 1 Drawing Sheet

RECORDING SHEET FOR INK-JET PRINTING

FIELD OF INVENTION

The present invention relates to a recording sheet. More specifically, it relates to a recording sheet employed in ink-jet printing.

BACKGROUND OF INVENTION

The use of ink-jet printing systems has grown dramatically in recent years. This growth may be attributed to substantial improvements in print resolution and overall print quality coupled with appreciable reduction in cost. Today's ink-jet printers offer acceptable print quality for many commercial, business, and household applications at costs fully an order of magnitude lower than comparable products available just a few years ago. Notwithstanding their recent success, intensive research and development efforts continue toward improving ink-jet print quality. In general, ink-jet print quality still falls short of that produced by more expensive technologies such as photography and offset or gravure printing. A surge in interest in ink-jet imaging (e.g., the rendition of pictures) has resulted in the need to produce near photographic quality printed images at a reasonable cost. The challenge remains to further improve the lightfastness of ink-jet printed images.

Currently, many of the commercial ink-jet print samples degrade with exposure to light. Current solutions for reducing the fading of ink-jet print samples have included adding Ultra Violet absorber additives to the media or ink formulation; lamination of the print after sample generation; and using lightfast colorants in the inks; adding metallic mordants to the media; and using custom-made metal containing colorants in the ink. Although these solutions have merits, they may pose disadvantages such as: increase cost due to lamination; cost, availability, and pen performance and print quality trade offs in the case of lightfast colorants; and potential toxicity with the use of metallic mordants.

Thus, challenge remains to further improve the lightfastness of ink-jet prints using cost-effective means.

DISCLOSURE OF INVENTION

In accordance with the invention, recording sheet is disclosed comprising a substrate, having on at least one side thereon, and an ink absorbent layer, said ink absorbent layer comprising alumina sol, at least one gelling agent, at least one cyclodextrin compound, and optionally, at least one binder. The ink absorbent layer may further comprise at least one viscosity modifying compound and at least one gloss enhancing compound. The recording sheet of the present invention provides enhanced lightfastness properties.

DETAILED DESCRIPTION OF THE INVENTION

Figure 1:
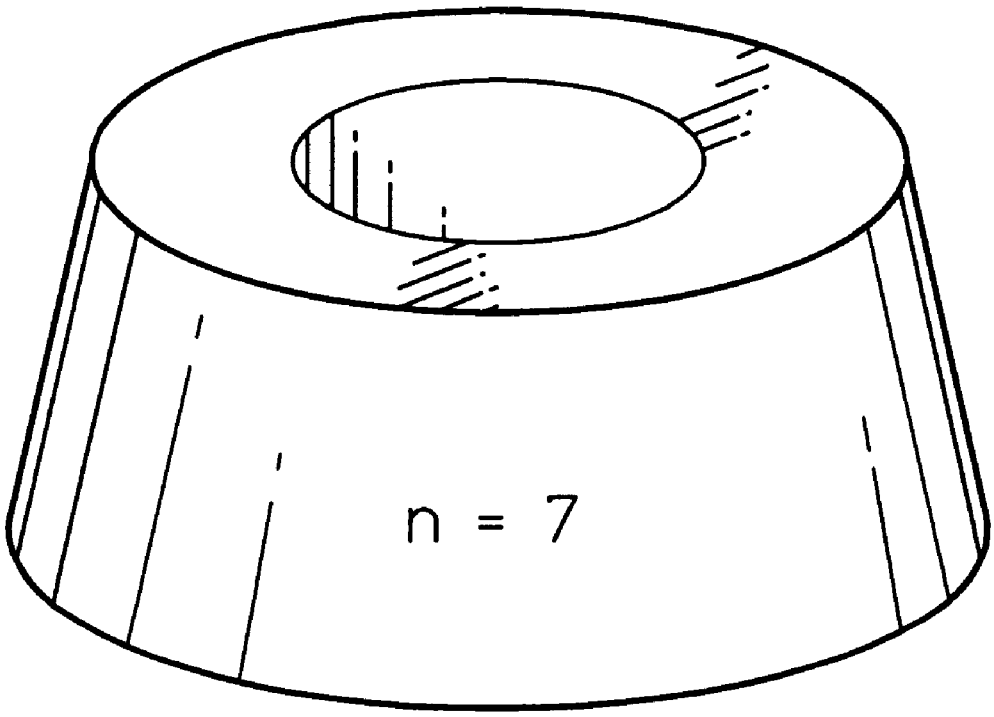
FIG. 1 is a topographical representation of a cyclodextrin compound.

In accordance with the invention a recording sheet suitable for use in ink-jet printers and method for formulating the same is provided. The present recording sheet provides excellent lightfastness. The recording sheet enables an ink-jet color printer to produce high quality color images having excellent lightfastness with a range of inks.

More specifically, the recording sheet of the present invention comprises a substrate; and an ink absorbent layer on said substrate, said ink absorbent layer comprising at least one alumina sol compound, at least one gelling agent, at least one cyclodextrin compound, and optionally at least one binder. The ink absorbent layer may further comprise at least one viscosity modifying compound and at least one gloss enhancing compound.

All the concentrations are given in weight percent (wt %) unless otherwise stated. Similarly, the concentration of the components are based on the concentration of each component in the dry, finished form of the coating layer (and not the concentration in the aqueous mixture).

Substrate

The suitable substrate may be transparent, opaque, or translucent. The substrate may be paper based or film based or any other material such as glass or metal. Preferably, the substrate is photobased coated paper. More preferably, the substrate is photobased paper having a coating for waterproofability, such as polyethylene. Optionally, the polyethylene coating has a coating thereon to improve coatability of the polyethylene layer with the ink absorbent layer. One such coating is gelatin which is commercially available. Alternatively, other means, such as corona discharge treatment, may be used to provide the improved coatability of the polyethylene layer. The polyethylene layer, in addition to improving waterproofing of the medium, also provides for the desired porosity, absorption, dry time, and smoothness.

Gelatin coated ink-jet media, typically comprise a polyethylene-coated substrate or paper support with a gelatin coating thereon. Gelatin coated ink-jet media have been described in patents such as U.S. Pat. No. 5,141,599 by Reiner et al., issued Aug. 25, 1992 and assigned to Felix Schoeller Company.

Ink Absorbent Layer

The substrate is coated with an ink absorbent layer comprising at least one alumina sol compound; at least one gelling agent; at least one cyclodextrin compound; and at least one binder. The ink absorbent layer may further comprise a component selected from the group consisting of at least one viscosity modifying compound and at least one gloss enhancing compound. The viscosity modifying (e.g., thickening) and the gloss enhancing functions may be provided by the same or different compounds.

The ink absorbent layer is prepared using the process below:

1. An aqueous stock solution of the optional binder is prepared sufficiently in advance of the coating application to allow adequate solubility of the binder. Optionally this mixture can be heated, for example to 85° C. for 30 minutes, to accelerate the solubilization of the binder, if necessary.
2. A cyclodextrin containing mixture is prepared by mixing alumina sol, the optional binder of step 1, cyclodextrin compound, and either or both optional viscosity modifying compound and gloss enhancing compound, at moderate shear.
3. A gelling agent solution is prepared.
4. The ink absorbent layer mixture is prepared by slowly adding the gelling agent solution to the cyclodextrin containing mixture from step 2. The ink absorbent layer mixture is further mixed at moderate shear for sufficient time to allow for the degassing of the mixture.

5. The mixture of step 4 is then transferred to a holding area and is kept there for sufficient length of time to allow for the removal of any bubbles in the mixture before it is used to coat the substrate.

The ink absorbent layer may be applied to the substrate using any one of well known coating methods such as roller coating, wire-bar coating, dip-coating, air-knife coating, slide coating, curtain coating, doctor coating, flexographic coating, or gravure coating.

Alumina Sol

Aluminas suitably employed in the present invention include so-called pseudo boehmite aluminas and boehmite aluminas. Such aluminas are commonly obtained by the hydrolysis of aluminum alkoxide in the well known fashion. The aluminum trialkoxide (alkoxide) can be produced, in the well known manner, by reacting a low molecular weigh alcohol, particularly a branched chain alcohol, with an aluminum bearing material. Such aluminum bearing materials include pure aluminum as well as aluminum alloys and mixed alloy scrap. Typical methods for preparing such aluminum alkoxides are shown, for example, in U.S. Pat. No. 4,242,271, incorporated herein by reference. The aluminum alkoxide can be hydrolyzed, in the well known manner, such as by the process taught in U.S. Pat. No. 4,202,870, incorporated herein by reference. Especially preferred are aluminas obtained from the hydrolysis of aluminum alkoxides derived from Ziegler Chemistry in the well known manner. While the preferred feedstock is an alumina slurry, particularly a slurry produced by the hydrolysis of aluminum alkoxides, aluminas from other sources can be formed into slurries and used for the present invention.

The alumina slurry can then be treated to produce water dispersible alumina colloidal sol using well known methods such as that described in, but not limited to, U.S. Pat. No. 4,676,928, and incorporated herein by reference. The water dispersible alumina is prepared by forming an aqueous alumina slurry from an uncalcined alumina obtained from the hydrolysis of an aluminum alkoxide; admixing a monovalent acid with said alumina slurry to produce an alumina slurry-acid composition having a pH of from about 5.0 to about 9.0; aging said alumina slurry-acid composition at an elevated temperature of above about 70° C. and for a period of time sufficient to convert the greater portion of said alumina to a colloidal sol; recovering said colloidal sol; and drying said colloidal sol.

In the process, the alumina slurry is first formed. This can be accomplished by dispersing an alumina in an aqueous medium. Preferably, as noted, the alumina slurry is one which has been obtained as the product of the hydrolysis of an aluminum alkoxide. Basically, when the aluminum alkoxide is hydrolyzed, there is formed an alumina hydrate plus the starting material alcohol from which the alkoxide was originally formed. Removal of the alcohol leaves an alumina slurry which can vary considerably in properties such as pH, alumina content, etc., but which in the case of aluminum alkoxides produced or derived from Ziegler Chemistry will generally be characterized by an alumina content of 9 to 15% by weight, usually 10 to 11.5% by weight and have a pH greater than about 9, usually ranging from about 9 to about 10.

The alumina slurry is treated with an acid to reduce the pH of the slurry from about 9 to about 5. Generally, this acidification of the alumina slurry is carried out with monobasic acids such as nitric acid, hydrochloric acid, formic acid, acetic acid, and so forth. The particular type of acid used depends, to a certain extent, upon the type of alumina contained in the slurry. However, it has been found that when dealing with an alumina slurry obtained from the hydrolysis of an aluminum alkoxide derived from Ziegler Chemistry, nitric acid is preferred. In admixing the acid with the alumina slurry, it is desirable that there be sufficient mixing to avoid gel formation in the slurry-acid mixture. It will be appreciated that the amount of acid added to the slurry will depend upon the initial pH of the slurry, the alumina content of the slurry, the type of acid employed, the total amount of slurry, etc. For example, in the case of an alumina slurry having an alumina content of between 10 and 11.5% by weight with a pH of from about 9 to about 10, it is generally necessary, when using nitric acid, to use approximately 15–500 ml of 70% nitric acid for 50 gallons of alumina slurry. It will be appreciated that the concentration of the acid used in the acidification step is not critical.

Once the alumina slurry has been adjusted to the desired pH range, i.e. from about 5 to about 9, the slurry is then aged at elevated temperatures until the greater portion of the alumina is in the form of a colloidal sol. Usually about 95 to 99% by weight of the alumina is converted to the colloidal sol form. The aging can be carried out in any manner such as in an oven, pressure vessel, etc. Generally speaking, the aging will result in a product which contains from about 1 to about 4% of undispersed alumina, i.e. alumina which is not in the form of colloidal sol. The amount of time required to convert the alumina to the colloidal sol varies with pH and temperature. While temperatures of from about 70° to about 100° C. are preferred when the process is conducted at ambient pressures, it will be recognized that temperatures greater than 100° C. can be used quite successfully if the process is conducted under super-atmospheric pressure. Indeed, in commercial operations, it is more desirable that higher temperature and pressures be employed in the aging step.

While it has been found that the pH of the aged colloidal sol decreases, it still remains above about 4 which, as noted above, is considered to be neutral in terms of acid dispersions of alumina.

The alumina sol is then recovered as by decantation or any other method well known to those skilled in the art and can either be transported as is for further processing into dried alumina or, it can be concentrated by removal of water to provide a concentrated colloidal sol which is pumpable and contains greater than about 12% by weight alumina. It has been found that with the process of the present invention, even though the alumina content of the concentrated sol exceeds about 12% by weight, the sol remains a low viscosity, easily pumpable medium. The dried alumina sol obtained from the fluid colloidal sol is, for practical purposes, completely water dispersible, i.e. greater than 98% dispersible. Alumina sol is also commercially available from companies such as Vista, Houston, Tex.

The concentration of the alumina sol in the ink receiving layer is from about 5 to about 95 wt %, preferably, from about 10 to about 90 wt %, and more preferably, from about 15 to about 85 wt %.

Gelling Agent

Gelling agents suitably employed in the practice of the invention include any non-toxic buffers that can provide the desired ionic strength to allow for the gelling of the mixture (mixture of step 4 above) within the desired time frame (e.g., after the degassing of mixture in step 4 above), multi-valent cations, and organic and inorganic acids and their salts. The gelling agents are used at a concentration sufficient to provide a rubbery gelatinous mass.

The buffers comprise a weak acid and its corresponding salt. Examples of such buffers include acetic acid/sodium acetate, phosphoric acid/sodium phosphate, and succinic acid/sodium succinate. Preferably, acetic acid/sodium acetate is used at a mixture pH range of from about 3 to about 7, and more preferably, from about 4 to about 5. By way of example, the acetic acid/sodium acetate buffer is used in a concentration range from about 0.02 to about 10 wt %/from about 0.02 to about 10 wt %; preferably from about 0.02 to about 8 wt %/from about 0.02 to about 8 wt %; and more preferably from about 0.02 to about 5 wt %/from about 0.02 to about 5 wt %.

The gelling agents are used at a concentration sufficient to provide a rubbery gelatinous mass. By way of example, the concentration of the at least one gelling agent in the ink receiving layer is from about 0.02 to about 20 wt %, preferably from about 0.02 to about 16wt %, and more preferably, from about 0.02 to about 10 wt %.

Cyclodextrin

Cyclodextrins (hereinafter referred to for convenience as CD or CDs for the singular and the plural, respectively) are cyclic oligosaccharides consisting of at least six glucopyranose units. These compounds have the simple, well-defined chemical structure shown in Structure I, below. The common designations of the lower molecular weight alpha (α)-, beta (β)-, and gamma (γ)-CDs are used throughout this specification and will refer to the chemical structure shown in Structure I wherein n=6, 7, or 8 glucopyranose units, respectively:

STRUCTURE I

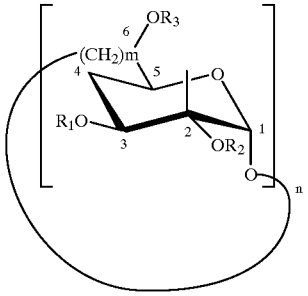

wherein $n \leqq 6$, preferably 8;

$m \leqq 1$, preferably 1;

$R_1$ is H, alkyl, or aryl; preferably H;

$R_2$ is H, alkyl, or aryl; preferably H; and $R_3$ is H, alkyl, or aryl; preferably H.

Topographically, the CDs may be represented as a torus, as shown in FIG. 1, the upper rim of which is lined with primary —$CH_2OH$ groups, and the lower rim with secondary hydroxyl groups. Coaxially aligned with the torus is a channel-like cavity of about 5, 6 or 7.5 A.U. diameter for the alpha-, beta-, and gamma-CDs, respectively. These cavities make the cyclodextrins capable of forming inclusion compounds with guest molecules of suitable diameters. In the practice of the present invention, the guest molecule is any dye suitable for the application for which the recording sheet is used. Preferably, the dye is an aromatic dye, and more preferably, an anionic aromatic dye. When the optional quaternary ammonium compound is used, it reacts with the anionic dye to impart waterfastness on the imaged recording sheet. The cyclodextrin compound also provides for inclusion of other components in the ink such as metal ions.

A reasonably large number of CD derivatives have been prepared and described in the literature. In general, these chemically modified CDs are formed by reaction of the primary or secondary hydroxyl groups attached to carbons 2, 3 or 6 [Structure I], without disturbing the alpha (1, 4) hemiacetal linkages. α-cyclodextrin is formed by cyclization of bonding of six glucose molecules, while β- and γ-cyclodextrines are formed by the bonding of seven and eight glucose molecules, respectively. Review of such preparations is given in "Tetrahedron Report Number 147, Synthesis of Chemically Modified Cyclodextrins", A. P. Croft and R. A. Bartsch, Tetrahedron 39(9):1417–1474 (1983), incorporated herein by reference for background (hereinafter referred to as "Tetrahedron Report No. 147").

In particular, alpha (α)-, beta (β)-, and gamma (γ)- CD sulfates (Na salt) are shown as Compound Nos. 207, 208, and 209 in Tetrahedron Report No. 147, (supra) Table 26, p.1456. U.S. Pat. No. 2,923,704 to Berger describes the preparation of cycloamylose sulfates. U.S. Pat. No. 4,020, 160 to Berstein et al. and U.S. Pat. No. 4,247,535 and 4,258,180 to Lewis et al. disclose the use of modified cyclodextrin sulfates as complement inhibitors. U.S. Pat. No. 4,383,992 to Lipari describes the preparation of a water-soluble inclusion compound of a steroid and unmodified beta -cyclodextrin.

The preferred cyclodextrin compound is in the practice of the present invention is γ-Cyclodextrin (n=8) commercially available from sources such as Wacker Chemicals, Norwalk, Conn.

The concentration of the at least one cyclodextrin compound in the ink receiving layer is from about 1 to about 40 wt %, preferably, from about 2 to about 35 wt %, and more preferably, from about 3 to about 30 wt %.

Binder

The ink absorbent layer may optionally comprise at least one binder to provide for physical strength. Binders suitably employed in the present invention are capable of forming hydrogen bond. It is usually possible to employ an organic material such as starch or its modified products, polyvinyl alcohol (PVOH) or its modified products, SBR latex, NBR latex, hydroxycellulose or polyvinylpyrrolidone, as the binder. PVOH is the preferred binder since it is possible to adequately improve the mechanical strength of the of ink absorbent layer without substantially impairing the desired physical properties of the pseudo-boehmite. PVOH is commercially available from companies such as Air-Product, Allentown, N.J., under the trade name AIRVOL 523. AIRVOL 523 has a viscosity in the range from about 23 to about 27 cps for a 4 wt % aqueous solution at 20° C. with from about 87 to about 89% hydrolyzed PVOH. In general, the viscosity of the coating mixture at which the mixture will fully gel at 24 hours will drive the selection of the binder's molecular weight and degree of hydrolysis.

The concentration of the optional at least one binder in the ink receiving layer is from about 0 to about 50 wt %, preferably, from about 0.1 to about 45 wt %, and more preferably, from about 0.5 to about 40 wt %.

Other Ingredients

Optionally thickening agents may be used in the ink absorbent layer. Suitable thickeners in the practice of the invention include, but are not limited to, polyacrylates, Texanol(a ester acrylate), HEC(Hydroxy ethyl cellulose), HPC (Hydroxy propyl cellulose), PEO (polyethyleneoxide), and PVOH. Basically, a thickener is able to increase the viscosity of the mixture as the result of change in one or more physical properties of the bulk material, such as pH. The thickener, when used, has a concentration in the range from about 0 to about 50 wt %, preferably, from about 0.5 to about 45 wt %, and more preferably, from about 0.5 to about 40 wt %.

Optionally gloss enhancers may be used in the ink absorbent layer. Suitable gloss enhancers include, but are not limited to, polyurethanes, PU(polyurethane), PEO (polyethyleneoxide), and PVOH. The gloss enhancer, when used, has a concentration in the range from about 0 to about 50 wt %, preferably, from about 0.5 to about 45 wt %, and more preferably, from about 0.5 to about 40 wt %.

Alternatively, one compound may be used to provide both the thickening and gloss enhancing functions. Examples of such compounds include polyacrylate/polyurethane block copolymers available by Rohm & Hass Company under designation of Acrysol RM2020 NPR, and random and block copolymers of styrene, butadiene, methyl methacrylate and or with polyacrylates and polymethacrylates.

EXAMPLES

Effect Of Cyclodextrin On Lightfade

Recording sheets coated with an ink absorbent layer according to the present invention were prepared using the following procedure:

Stock Solution Preparation

A 5 wt % stock solution of PVOH was prepared by mixing 5 lbs of PVOH and 95 lbs of water. The PVOH stock solution was prepared four days prior to the coating of the substrate to allow for solubility and degassing of the PVOH.

Ink Absorbent Layer Preparation

The absorbent layer mixture was prepared by mixing the ingredients described in Table 1, according to the steps recited below:

A. The aluminum sol, PVOH, the cyclodextrin, and Acrysol were mixed together at moderate shear.

B. Sodium acetate and acetic acid were mixed in water until dissolved.

C. The "B" mixture was added to the "A" mixture and stirred at moderate shear. The rate of addition for this step was 328 lbs/hr.

D. After the completion of step "C", the resulting mixture was stirred at a low shear to allow for degassing of the components.

E. The mixture of step D was then transferred to a container and held for 48 hours before being used to coat the substrate.

TABLE 1

| COMPONENT | WEIGHT (LBS) TO PREPARE A 50 LBS COATING MIXTURE |
|---|---|
| Alumina Sol (Dispal 23N4-20[1]) - 20% stock solution | 15 |
| Acetic acid | 0.1421 |
| Sodium acetate | 0.1118 |
| PVOH (Airvol 523[2]) - 5% stock solution[3] | 11 |
| Acrysol RM2020 NPR[4] | 3.25 |
| Cyclodextrin[5] | 1 |
| Make up Water | 19.5 |

[1]Dispal 23N4-20 available from Vista, Houston, TX.
[2]Airvol 523 available from AirProduct, Allentown, PA.
[3]The stock solution of PVOH prepared above.
[4]Acrysol RM2020 NPR available from Rhom & Hass.
[5]Cyclodextrin available from Wacker Chemicals, Norwalk, CT.

Coating of Substrate

The ink absorbent layer mixture was used to coat a polyethylene based substrate having a gelatin coating thereon.

Lightfastness Evaluation

The effect of cyclodextrin on lightfade was measured by printing step tablet images on recording sheets prepared according to the procedure described above. Each image comprised color palette squares of varying density approximately 1 $cm^2$, using a Hewlett-Packard Deskfet Photosmart printer (part number C3804A) and Hewlett-Packard Photosmart series ink/print cartridges (art numbers C3844A and C3845A), all commercially available from Hewlett-Packard Company. The color palettes were generated using Dot on Dot print mode to generate palettes with "Status A" reflection optical densities bracketing 0.3, 0.6, and 1.0 densities.

The print samples (step tablet images) were first quantified for Status A "initial" (before exposure) optical densities, OD's, and then exposed to the equivalent of five years of indoor lightfade (12 hrs/day for 365 days/yr×5 yrs at 450 lux of Cool White Fluorescent illuminant) using an accelerated exposure with an Atlas HPLV fade chamber (available from Atlas Electric Devices Co., Chicago Ill.). Following light exposure, the samples were again quantified as to OD's at the same locations on each step to yield "after" exposure densities. The Status A optical densities, OD's, of the images were measured using an X-Rite Model 938 Densitometer, available from X-Rite Inc., Grandville, Mich. The lightfade for each sample step density was calculated as a percent density loss (Equation I) by using the average of three separate measurements. The % density loss at 0.3, 0.6, and 1.0 densities were calculated by linear interpolation of the results for the bracketing steps, and are reported in Table 2.

EQUATION I $$((\text{OD before fade}—\text{OD after fade})/(\text{OD before fade}))*100\%$$

TABLE 2

| Cyclodextrin in the Recording Sheet Media/ wt. % | OD % Loss (K/C/M/Y)[1] after 5 years indoor lightfade 0.30 OD | 0.60 OD | 1.00 OD |
|---|---|---|---|
| Gamma W8/ 12.6% | 16.0/10.6/ 18.3/19.8 | 12.3/14.1/ 18.6/13.5 | 9.0/9.1/ 12.9/6.6 |
| Alpha W6/ 12.6% | 11.3/8.2/ 21.6/19.9 | 9.8/7.0/ 20.0/10.4 | 7.8/8.5/ 12.5/4.1 |
| Beta W7/ 12.6% | 25.3/21.4/ 35.7/12.8 | 23.2/25.0/ 28.0/9.0 | 17.1/26.5/ 18.8/5.9 |

TABLE 2-continued

| Cyclodextrin in the Recording Sheet Media/ wt. % | OD % Loss (K/C/M/Y)[1] after 5 years indoor lightfade 0.30 OD | 0.60 OD | 1.00 OD |
|---|---|---|---|
| Beta W7 M1.8/ 12.6% | 20.5/9.4/ 27.4/17.0 | 13.5/12.7/ 17.5/8.3 | 11.0/11.9/ 13.2/3.0 |
| Control/ 0% | 16.0/12.1/ 34.7/16.1 | 16.4/14.9/ 34.6/9.2 | 13.7/17.9/ 30.5/4.5 |

[1]K/C/M/Y refers to black/cyan/magenta/yellow colors.

As can be seen from the results in Table 2, recording sheets, having an ink receiving layer according to the present invention, exhibited better overall lightfastness.

INDUSTRIAL APPLICABILITY

The present recording sheets are expected to find commercial use in ink-jet printing.

Thus, there has been disclosed a recording sheet comprising a substrate, having on at least one side thereon, and an ink absorbent layer, said ink absorbent layer comprising alumina sol, at least one gelling agent, at least one cyclodextrin compound, and optionally, at least one binder. It will be readily apparent to those skilled in the art that various changes and modifications of an obvious nature may be made without departing from the spirit of the invention, and all such changes and modifications are considered to fall within the scope of the invention as defined by the appended claims.

What is claimed is:

1. A recording sheet comprising a substrate, having on at least one side thereon, an ink absorbent layer, said ink absorbent layer made from a composition consisting essentially of:

a mixture of alumina in colloidal sol form and at least one cyclodextrin compound;

at least one gelling agent at a concentration sufficient to make the composition a rubbery gelatinous mass, the gelling agent selected from the group consisting of non-toxic buffers, multi-valent cations and organic and inorganic acids and their salts;

a binder; and water.

2. The recording sheet of claim 1 wherein the at least one cyclodextrin compound has a structure

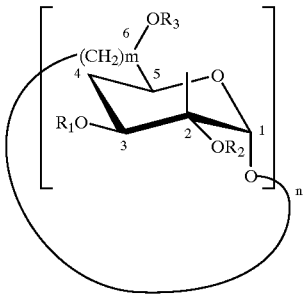

wherein n is at least 6, 7 or 8;

m is at least 1;

$R_1$ is H, alkyl, or aryl;

$R_2$ is H, alkyl, or aryl; and $R_3$ is H, alkyl, or aryl.

3. The recording sheet of claim 2 wherein n is 8.

4. The recording sheet of claim 2 wherein m is 1.

5. The recording sheet of claim 2 wherein $R_1$ is H.

6. The recording sheet of claim 2 wherein $R_2$ is H.

7. The recording sheet of claim 2 wherein $R_3$ is H.

8. The recording sheet of claim 1 wherein said at least one cyclodextrin compound in said ink absorbent layer in dry form has a concentraton from about 1 to about 40 wt %.

9. The recording sheet of claim 8 wherein the concentration of said at least one cyclodextrin compound is from about 2 to about 35 wt %.

10. The recording sheet of claim 9 wherein the concentration of said at least one cyclodextrin compound is from about 3 to about 30 wt %.

11. A method for preparing a recording sheet, comprising the steps of:

preparing a cyclodextrin containing mixture consisting essentially of alumina in colloidal sol form and at least one cyclodextrin compound;

preparing a gelling agent selected from the group consisting of non-toxic buffers, multi-valent cations and organic and inorganic acids and their salts;

preparing an ink absorbent layer composition by adding said gelling agent to said cyclodextrin containing mixture, the gelling agent being at a concentration sufficient to make the composition a rubbery gelatinous mass;

mixing said ink absorbent layer mixture for sufficient time to allow for the degassing of said mixture;

providing a substrate;

and coating said substrate with said ink absorbent layer mixture.

12. The method of claim 11 wherein said at least one cyclodextrin compound is a γ-cyclodextrin.

13. A method for preparing a recording sheet, comprising the steps of:

preparing an aqueous binder solution;

preparing a cyclodextrin containing mixture consisting essentially of alumina in colloidal sol form, at least one cyclodextrin compound, and said binder solution;

preparing a gelling agent selected from the group consisting of non-toxic buffers, multi-valent cations and organic and inorganic acids and their salts;

preparing an ink absorbent layer composition by adding said gelling agent to said cyclodextrin containing mixture, the gelling agent being at a concentration sufficient to make the composition a rubbery gelatinous mass;

mixing said ink absorbent layer composition for sufficient time to allow for the degassing of said mixture;

providing a substrate;

and coating said substrate with said ink absorbent layer mixture.

14. The method of claim 13 wherein said at least one cyclodextrin compound is a γ-cyclodextrin.

15. A recording sheet comprising a substrate, having on at least one side thereon, an ink absorbent layer, said ink absorbent layer made from a composition consisting essentially of:

a mixture of alumina sol in colloidal sol form and at least one cyclodextrin compound;

at least one gelling agent at a concentration sufficient to make the composition a rubbery gelatinous mass, the gelling agent selected from the group consisting of non-toxic buffers, multivalent cations and organic and inorganic acids and their salts;

at least one binder; and a component selected from the group consisting of a viscosity enhancing compound and a gloss enhancing compound;

and water.

16. The recording sheet of claim 15 wherein the at least one cyclodextrin compound has the structure

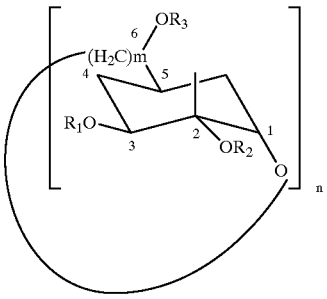

wherein n is 6, 7 or 8;

m is at least 1;

$R_1$ is H, alkyl, or aryl;

$R_2$ is H, alky, or aryl; and $R_3$ is H, alkyl, or aryl.

17. The recording sheet of claim 15 wherein n is 8.

18. The recording sheet of claim 15 wherein m is 1.

19. The recording sheet of claim 15 wherein $R_1$ is H.

20. The recording sheet of claim 15 wherein $R_2$ is H.

21. The recording sheet of claim 15 wherein $R_3$ is H.

22. The recording sheet of claim 15 wherein the concentration of said at least one cyclodextrin compound in said ink absorbent layer in dry form is from about 1 to about 40 wt %.

23. The recording sheet of claim 22 wherein the concentration of said at least one cyclodextrin compound is from about 2 to about 35 wt %.

24. The recording sheet of claim 23 wherein the concentration of said at least one cyclodextrin compound is from about 3 to about 30 wt %.

25. A method for preparing a recording sheet, comprising the steps of:

preparing a cyclodextrin containing mixture consisting essentially of alumina in colloidal sol form, at least one cyclodextrin compound, and a component selected from the group consisting of a viscosity enhancing compound and a gloss enhancing compound;

preparing a gelling agent selected from the group consisting of non-toxic buffers, multi-valent cations and organic and inorganic acids and their salts;

preparing an ink absorbent layer composition by adding said gelling agent to said cyclodextrin containing mixture, the gelling agent being at a concentration sufficient to make the composition a rubbery gelatinous mass;

mixing said ink absorbent layer mixture for sufficient time to allow for the degassing of said mixture;

providing a substrate;

and coating said substrate with said ink absorbent layer mixture.

26. A method for preparing a recording sheet, comprising the steps of:

preparing an aqueous binder solution;

preparing a cyclodextrin containing mixture consisting essentially of alumina in colloidal sol form; at least one cyclodextrin compound, said binder solution, and a component selected from the group consisting of a viscosity enhancing compound and a gloss enhancing compound;

preparing a gelling agent selected from the group consisting of non-toxic buffers, multi-valent cations and organic and inorganic acids and their salts;

preparing an ink absorbent layer composition by adding said gelling agent to said cyclodextrin containing mixture, the gelling agent being at a concentration sufficient to make the composition a rubbery gelatinous mass;

mixing said ink absorbent layer composition for sufficient time to allow for the degassing of said mixture;

providing a substrate;

and coating said substrate with said ink absorbent layer mixture.

* * * * *

UNITED STATES PATENT AND TRADEMARK OFFICE

CERTIFICATE OF CORRECTION

PATENT NO. : 6,440,535 B1
DATED : August 27, 2002
INVENTOR(S) : Iu et al.

It is certified that error appears in the above-identified patent and that said Letters Patent is hereby corrected as shown below:

Column 9,
Line 65, delete "at least 6, 7 or 8;" and insert therefor -- 6, 7 or 8; --.

Signed and Sealed this

Eighteenth Day of November, 2003

JAMES E. ROGAN
*Director of the United States Patent and Trademark Office*